US011185174B2

(12) United States Patent
Ponce et al.

(10) Patent No.: US 11,185,174 B2
(45) Date of Patent: Nov. 30, 2021

(54) COUNTER WITH AIR CONDITIONING AND FREEZING SYSTEM

(71) Applicant: MELIUS INTEGRAL, S.L., Barcelona (ES)

(72) Inventors: Ramon Ponce, Barcelona (ES); Luis Ponce, Barcelona (ES); Javier Prió, Barcelona (ES)

(73) Assignee: MELIUS INTEGRAL, S.L., Barcelona (ES)

( * ) Notice: Subject to any disclaimer, the term of this patent is extended or adjusted under 35 U.S.C. 154(b) by 0 days.

(21) Appl. No.: 17/055,794

(22) PCT Filed: Apr. 12, 2019

(86) PCT No.: PCT/EP2019/059492
§ 371 (c)(1),
(2) Date: Nov. 16, 2020

(87) PCT Pub. No.: WO2020/015870
PCT Pub. Date: Jan. 23, 2020

(65) Prior Publication Data

US 2021/0227997 A1 Jul. 29, 2021

(30) Foreign Application Priority Data

Jul. 18, 2018 (EP) ..... 18382537

(51) Int. Cl.
*A47F 3/04* (2006.01)

(52) U.S. Cl.
CPC ..... *A47F 3/0413* (2013.01)

(58) Field of Classification Search
CPC .... A47F 3/0413; A47F 3/0439; A47F 3/0443; A47F 3/0447; A47F 3/0456; F25D 23/023; F25D 17/04; F25D 17/06; F25D 17/08
See application file for complete search history.

(56) References Cited

U.S. PATENT DOCUMENTS 5,675,983 A * 10/1997 Ibrahim ..... A47F 3/0408 62/255

FOREIGN PATENT DOCUMENTS

| | | | |
|---|---|---|---|
| CH | 460066 | A | 7/1968 |
| EP | 2374377 | A1 | 10/2011 |
| NL | 8502329 | A | 3/1987 |

OTHER PUBLICATIONS

International Search Report, in English, dated Aug. 2, 2019 by the European Patent Office in application PCT/EP2019/059492.

(Continued)

*Primary Examiner* — Joseph F Trpisovsky
(74) *Attorney, Agent, or Firm* — Hassan Abbas Shakir; Shakir Law PLLC

(57) ABSTRACT

A counter with air conditioning and freezing system includes a self-supporting structure (C) with a housing and a support for trays (A, B), an insulated exterior air conditioning and freezing system (D) with thermally insulated columns (D1) which extend from the self-supporting structure (C), and a thermally insulated horizontal conduit (D2), a longitudinal groove (D3) oriented towards the housing to allow the exit of air and an exterior plate (D4) to control the exit direction of the air. It includes an insulated interior air conditioning and freezing system (R) to direct an air current through the interior of the self-supporting structure (C) and which comprises a frontal return opening (R1) which connects to conduits redirecting the air towards a grill (R9) from the interior of the housing and towards the insulated exterior air conditioning and freezing system (D).

26 Claims, 25 Drawing Sheets

(56) References Cited

OTHER PUBLICATIONS

Written Opinion, in English, dated Jan. 23, 2020 (per date of PCT/ISA/210) by the European Patent Office in application PCT/EP2019/059492.
European Search Repod, in English, dated Jan. 16, 2019 by the European Patent Office in application EP 18382537.

* cited by examiner

COUNTER WITH AIR CONDITIONING AND FREEZING SYSTEM

OBJECT OF THE INVENTION

The present invention relates to the technical field of counters in which products are displayed which are supposed to be maintained in certain moisture and temperature conditions.

The counter allows products to be conveniently offered to the consumer, guaranteeing their correct preservation conditions. It comprises supports for trays and trays on which the products are placed and can be displaced and the products are offered to the user with the counter open. To this end, it has an air conditioning and freezing system which maintains the products in the necessary temperature conditions even when it is open.

BACKGROUND OF THE INVENTION

At present, the use of different types of devices is known for displaying products to consumers who may be interested in consuming them. Some products are non-perishable and therefore, the only requirements that the devices, in which they are placed, should meet are ease of storage and convenience of access of the consumers to said products.

However, in many cases it is desired to provide consumers with products which are perishable and/or which have to be preserved in certain temperature conditions. To solve this problem, it is known in the prior art to use refrigerators with glass doors. This solution is the most popular in the sector since it allows the user to have visual access to the products before selecting them. When the user has decided which product they want, they have to open the door and access the interior of the display device to take the product.

The problem associated with these types of devices is that many times the users are in a hurry and do not stop to look at the content protected by the glass doors. Generally, when a consumer is, for example, in a supermarket, they have to carry in their shopping basket the products which are more easily accessible. That is to say, the consumers tend to take the products which are at the level of eyes and/or hands and which they can take directly. In many cases, the fact of having to open doors to take the products means that they are disregarded.

Thus, another solution used in the prior art is to place the products in open counters. The most significant problem associated with this solution is related to the preservation of the perishable products desired to be displayed in them. In the majority of cases, it is necessary for the workers of the establishment in which the products are displayed to have to store them overnight in air conditioned chambers and each day transfer them to the counter, where they are displayed to encourage their consumption. These operations involve a significant loss of time each day for moving the products. Additionally, these counters do not guarantee the correct preservation of the products since they do not allow a suitable temperature to be ensured.

DESCRIPTION OF THE INVENTION

The present invention proposes a counter with an air conditioning and freezing system. The most significant advantage of the present invention is that it allows certain temperature conditions of the products to be ensured even when the counter is open, creating a curtain of air conditioned air over the opening of the counter to prevent energy loss and the loss of the air which has already been cooled.

The counter comprises a self-supporting structure with a housing in which at least one support for trays is located in which products desired to be displayed are placed. To facilitate access of the consumers/users to said products, the counter may comprise a lifting mechanism responsible for moving the tray supports to the user (and consequently the trays with the products). Additionally, to facilitate access to the products even further, the counter may remain in an open position. In this way, the user does not have to open any cover to take the products and, when in the highest position, makes it more convenient to take the products. It is not necessary for the user to bend or make any effort to take things from the bottom of the counter.

In order to maintain the temperature in the interior of the self-supporting structure, the counter comprises an air conditioning and freezing element which allows the temperature of an air current circulating through the interior of said structure to be modified.

The air conditioning comprises three fundamental factors which are ventilation, heating and refrigeration. In this case, the counter can be air conditioned (including the three factors described) and also freeze, that is to say, obtain negative temperatures of up to −60° C. When a higher temperature is desired to be maintained, that is to say, to use hot air for the refrigeration, in addition to the air conditioning and freezing element described, the counter may comprise additional interconnected or independent heating systems.

The counter comprises an insulated interior air conditioning and freezing system arranged in the self-supporting structure with a frontal return opening arranged in an upper frontal section of the support structure. The frontal return opening is an air passage opening to an insulated frontal vertical return through which the air current, entering through said frontal return opening, passes. From here, the air is sent to a horizontal air passage connected to the insulated frontal vertical return by way of a first grill and which is arranged below the housing. The air subsequently arrives to an insulated rear vertical return through which the air, arriving from the horizontal air passage by way of a second grill, passes and which is connected by way of a third grill to the housing.

The counter also comprises an insulated exterior air conditioning and freezing system with at least one thermally insulated column which extends from the self-supporting structure and which is hollow and is connected to said self-supporting structure to allow the passage of air from said structure. It also comprises a thermally insulated horizontal conduit to which the air, passing through the column, is directed and from which it exits by way of a longitudinal groove. It also comprises an exterior plate, in correspondence to the longitudinal groove which allows the direction in which said air exits to be controlled. When this direction is controlled, the air is oriented towards a frontal return opening arranged in the self-supporting structure, thus creating an air curtain.

The air curtain which is established remains on top of the products, even when the counter is open and the supports are in an elevated position. Owing to the air curtain created, suitable preservation of the products is guaranteed at the desired temperature.

The counter may be in a closed position, in a first open position and in a second open position. In the closed position, only the temperature conditions of the interior of the housing of the counter are controlled. In the first open position, the temperature conditions of the interior of the housing and an area in which are displayed the products of the trays in the tray supports are controlled. In the second open position, only the temperature of the area is controlled in which the products are displayed.

The counter comprises at least one valve arranged at the end (or on the base) of the thermally insulated columns which connects to the interior of the self-supporting structure and to the air redirecting conduits. The valve can move between a closed position in which it prevents the passage of conditioned or frozen air from the interior of the housing towards the insulated exterior air conditioning and freezing system and an open position in which it allows said passage.

The counter can be in a closed position, with the valve closed and the third grill open; in a first open position with the valve and the third grill open simultaneously; or in a second open position, with the valve open and the third grill closed.

When the counter is in a closed position, the valve is closed so that the recirculation of the air only takes place through the interior of the self-supporting structure. The regulation of the cold/hot air flow and the temperature and moisture conditions are controlled from the exterior. In this case, the third grill is open to allow the passage of air from the insulated rear vertical return towards the return frontal opening, passing through the housing to control the temperature of the same. In this position, the third grill can be open completely or partially.

When the counter is in the first open position, the temperature of the interior of the housing and of the display area (where the products are located with the display open) is controlled. In this case, the valve is open to allow the passage of the air towards the insulated exterior air conditioning and freezing system and the third grill is open to allow the passage to the housing. The counter may also comprise additional fans arranged on the base of the thermally insulated columns to drive the air more efficiently. In said additional fans (extractors), the speed can be regulated to control the necessary flow of air which is necessary at each moment.

In the second open position, the temperature of the display area is controlled. To this end, the valve is in the open position, in the position desired for the control of the necessary flow. The counter can comprise an additional flap which can be closed to prevent the passage from the rear vertical return to the housing by way of the third grill. That is to say, in this case the air passes directly from the rear vertical return to the insulated exterior air conditioning and freezing system. In this case, the third grill is completely closed, by means of any system, which can also be a flow regulation system in the third grill itself. In this position, the additional fans can also be connected, if the counter has them.

Throughout the specification when reference is made to the counter, it is understood that said counter can be a refrigeration cabinet.

The counter can also comprise at least one measuring instrument of the temperature and moisture capable of communicating wirelessly with a remote control and/or data processing system of said counter.

Owing to the present invention, a much more versatile counter than the ones known from the prior art is provided since it allows the products to be stored in the counter when it is in a closed position and when it is desired to display them to the consumer, display them with the counter open. During the display time, owing to the air curtain created, the products are maintained in suitable temperature and moisture conditions. This allows them to be displayed for longer without this affecting their quality and/or expiry date.

In addition, the fact of having the products displayed in this counter, where they remain within view and reach of the consumer means that they are more attractive to said consumer. An increase in sales is thereby achieved, together with greater satisfaction of the consumers.

Additionally, the counter allows physical space to be saved since the products can be displayed and stored in the same space by means of the movement of the supports for trays and the placement of a cover.

DESCRIPTION OF THE DRAWINGS

In order to complement the description being made and with the object of helping to better understand the characteristics of the invention, in accordance with a preferred practical exemplary embodiment thereof, said description is accompanied, as an integral part thereof, by a set of drawings where, in an illustrative and non-limiting manner, the following has been represented.

PREFERRED EMBODIMENT OF THE INVENTION

Exemplary embodiments of the present invention are described below with the aid of the FIGS. 1 to 16.

The counter with air conditioning and freezing system of the present invention is seen for example in FIGS. 1A-B and FIGS. 2A-B. The counter comprises a self-supporting structure (C) with an insulated housing in which at least one support for trays (A, B) is located and with an air conditioning and freezing element which allows the temperature of an air current circulating through the self-supporting structure (C) to be modified.

In order to maintain the temperature in the interior of the self-supporting structure, the counter comprises an air conditioning and freezing element (M) which allows the temperature of an air current circulating through the interior of said structure to be modified.

The air conditioning comprises three fundamental factors which are ventilation, heating and refrigeration. In this case, the counter can be air conditioned (including the three factors described) and also freeze, that is to say, obtain negative temperatures of up to −60° C. When a higher temperature is desired to be maintained, that is to say, to use hot air for the refrigeration, in addition to the air conditioning and freezing element described, the counter may comprise additional interconnected or independent heating systems.

The air conditioning and freezing element allows the temperature of an air current circulating through the self-supporting structure (C) to be modified.

In the examples shown in the figures, the counter comprises two supports for trays (A, B) arranged at different heights so that the user has better visual access to the products which are placed on the corresponding trays.

As has been previously described, the key of the present invention is that it allows a suitable preservation temperature of the products to be maintained even when the counter is open. In FIGS. 1 A-B, two sectioned views of the counter in an open position are represented. As can be seen, in this case, a first tray support (A) protrudes outside of the housing of the self-supporting structure (C) and a second tray support (B) is arranged flush with an upper opening of said housing.

Figure 1A:
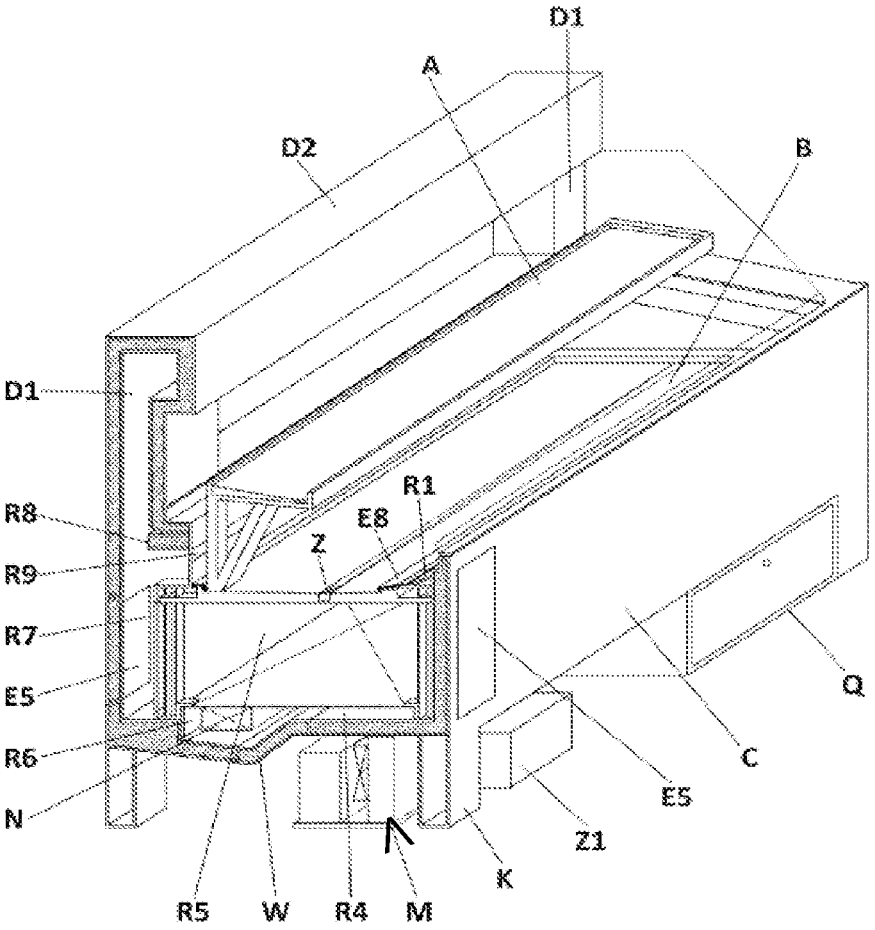
FIGS. 1 A-B show sections of the counter in a display position.
Figure 1B:
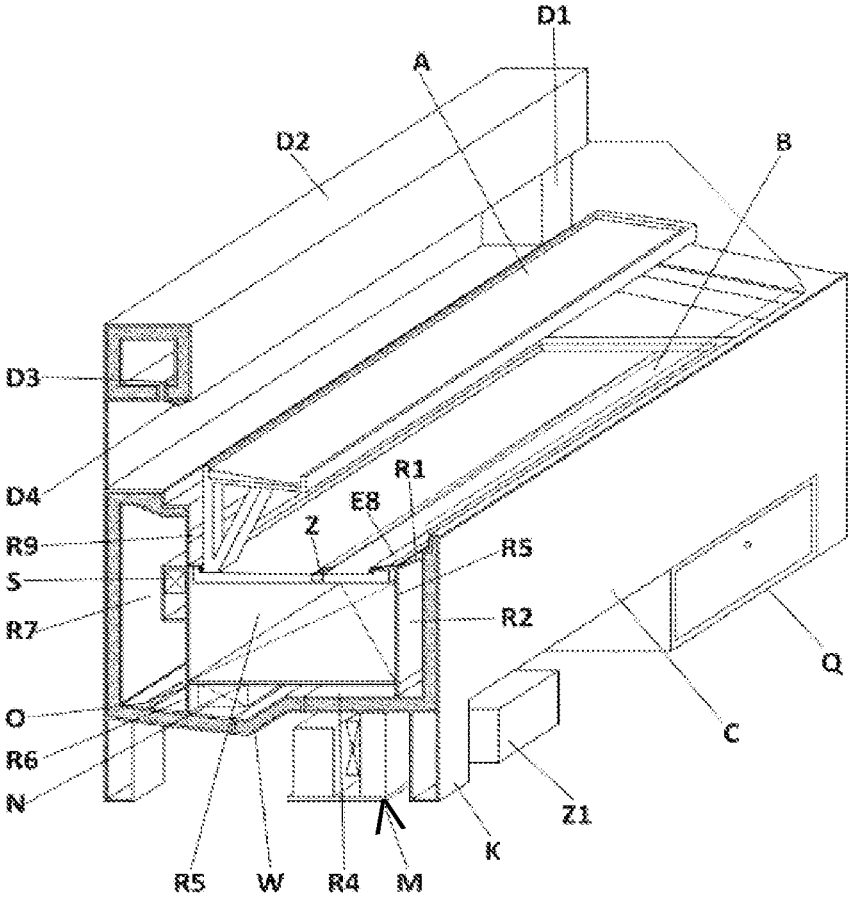
Figure 2A:
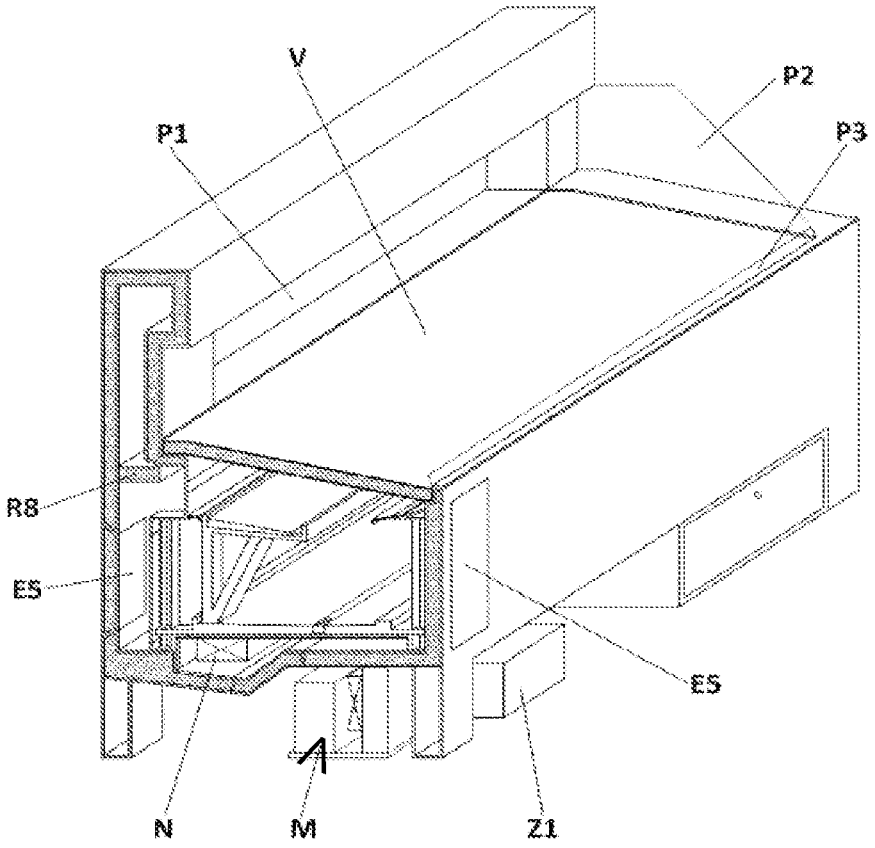
FIGS. 2A-B show sections of the counter in a storage position.
Figure 2B:
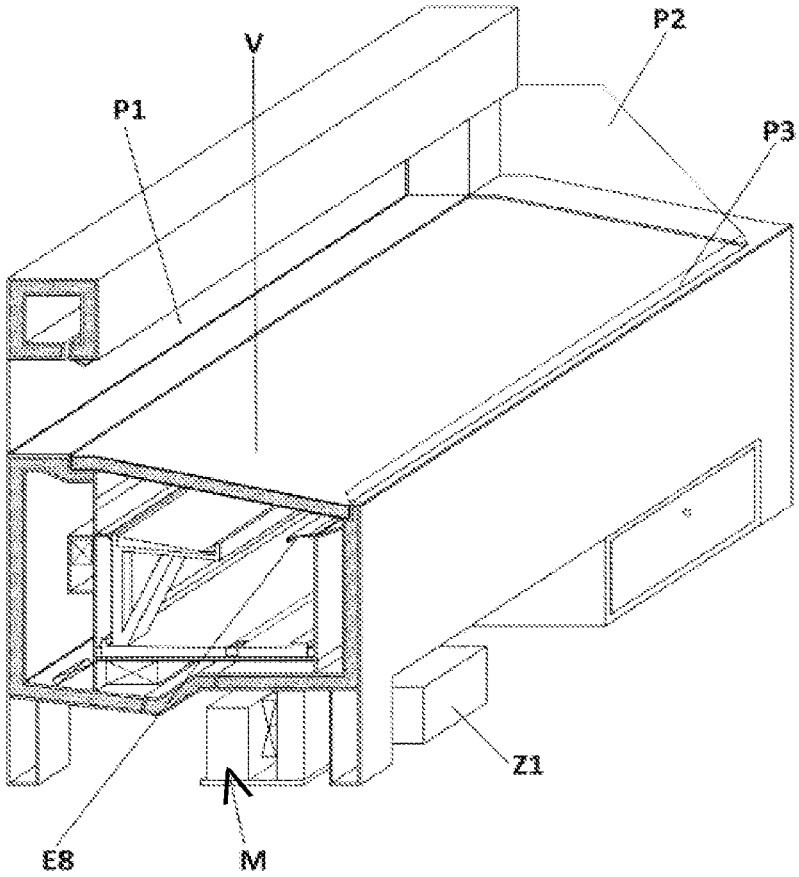

In FIGS. 2A-B, the same sections are shown but with the counter in a closed position. As can be seen, in this position, the two supports for trays (A, B) are arranged in the housing and it remains closed with a thermal insulation cover (V) for opening and closing the housing. In an exemplary embodiment, said cover (V) is a practicable integral screen.

Figure 3A:
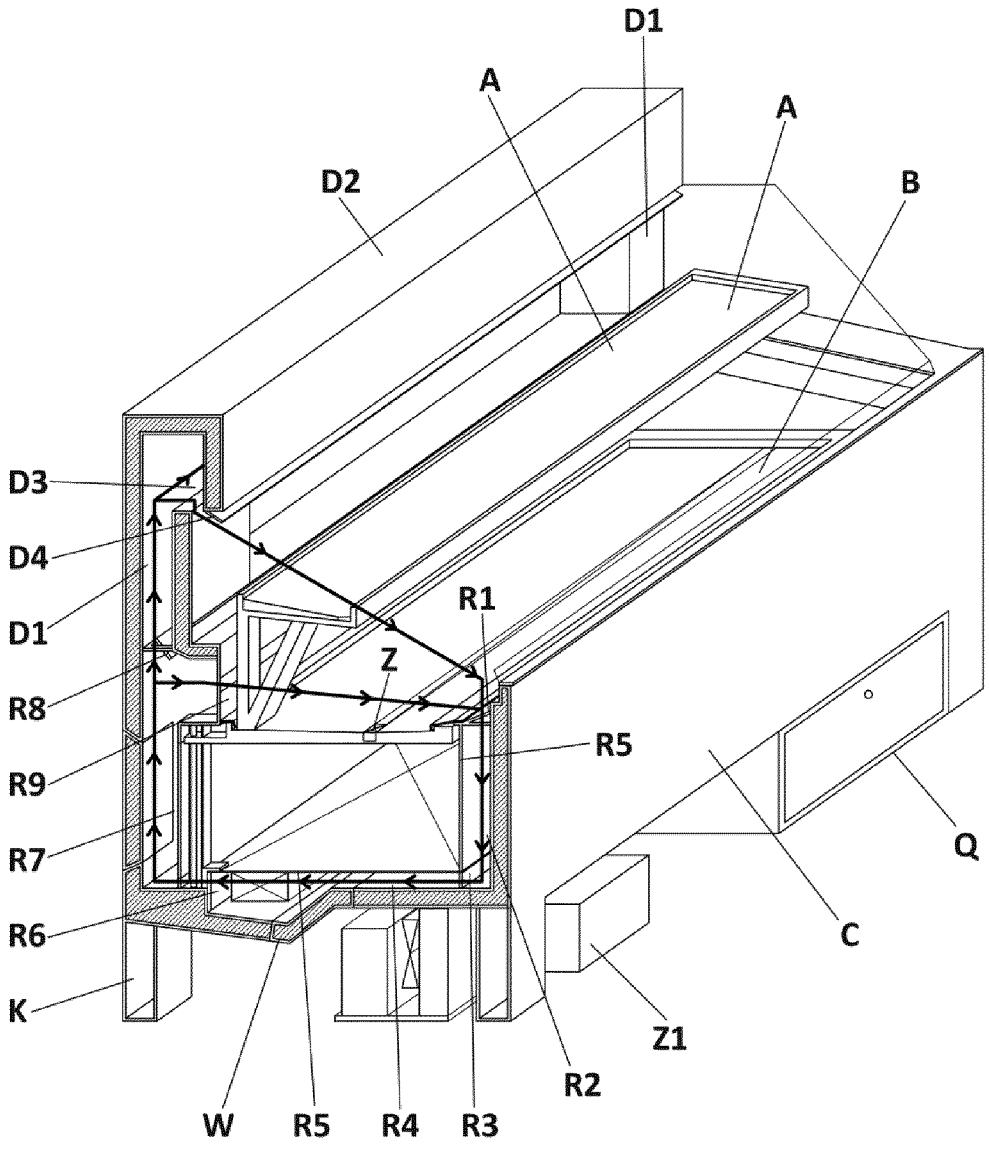
FIGS. 3A-B show sections of the counter in which the path of the air between the exterior and interior air conditioning and freezing system has been represented, showing the air curtain created when the counter is in a display position and showing the recirculation of the air through the interior of the housing when the counter is in a storage position respectively.
Figure 3B:
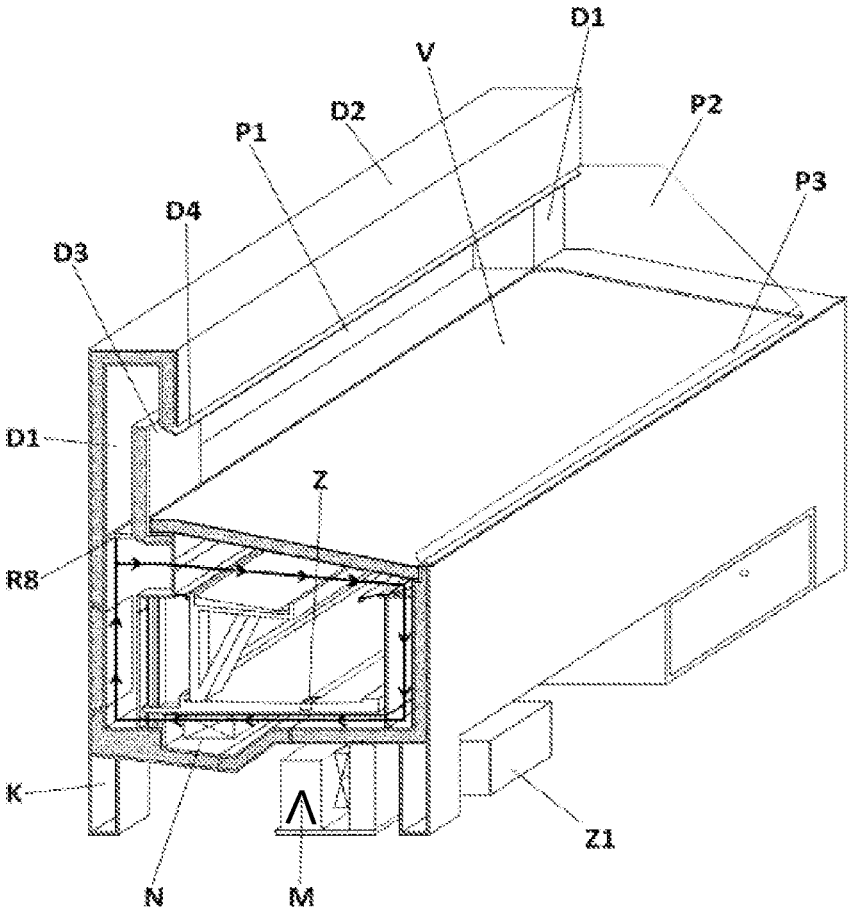

FIG. 3A shows an air curtain created in the counter over the supports for trays (A, B) in an open position of the counter. This air curtain guarantees that the products located on the trays are maintained in correct temperature conditions. FIG. 3B shows the counter in a closed position. The direction of the air recirculating through the interior of the self-supporting structure (C), around the housing, has been indicated. This recirculation of the air allows the products to be air conditioned and/or frozen to the desired temperature when the counter is closed.

In another exemplary embodiment, the counter has a geometry such that it allows the formation of a second air curtain in the rear part of the counter in the manner of rear protection.

As is observed for example in said FIGS. 3A-B, the counter comprises an insulated interior air conditioning and freezing system (R) arranged on the self-supporting structure (C) configured to direct an air current through the interior of the self-supporting structure (C). This system (R) comprises a frontal return opening (R1) arranged in an upper frontal section of the support structure (C). Additionally, it comprises an insulated frontal vertical return (R2) by way of which the air current pass, entering through the frontal return opening (R1), passes. It also has a horizontal air passage (R4) connected to the insulated frontal vertical return (R2) by way of a first grill (R3) and which is arranged below the housing. It also has an insulated rear vertical return (R7) through which the air, arriving from the horizontal air passage (R4) by way of a second grill (R6), passes and which is connected by way of a third grill (R9) to the housing.

In an exemplary embodiment, the insulated horizontal air passage (R4) is defined by a horizontal sheet (R5) which passes through an evaporator (N) which can be in any position of the structure always inside the thermally insulated self-supporting structure (C). The air is preferably displaced from the insulated horizontal passage (R4) to the rear vertical return (R7) by way of a second grill (R6) forced by means of fans (0).

The horizontal sheet (R5) delimits the housing, that is to say, the volume where the supports for trays (A, B) perform their movement and the frontal and rear vertical air returns (R2, R7) and the horizontal air passage (R4).

To achieve the objective of creating the air curtain when the counter is open, that is to say, maintaining the correct temperature even in the open position, the counter comprises an insulated exterior air conditioning and freezing system (D). This system (D) extends from a rear section of the self-supporting structure (C). As can be seen in the figures, it comprises at least one thermally insulated column (D1) which extends from the self-supporting structure (C) and which is hollow and is connected to the insulated rear vertical return (R7) to allow the passage of the air from said insulated rear vertical return (R7). Additionally, it has a thermally insulated horizontal conduit (D2) connected to the at least one thermally insulated column (D1) for the passage of the air from said thermally insulated column (D1).

The air exits from the thermally insulated horizontal conduit (D2) by way of a longitudinal groove (D3) which extends through the thermally insulated horizontal conduit (D2) and the system (D) also comprises an exterior plate (D4) arranged in correspondence with (D3) oriented at an inclination such that it controls the exit direction of the air which passes through the longitudinal groove (D3) and directs it towards the frontal return opening (R1), creating the air curtain.

Figure 4:
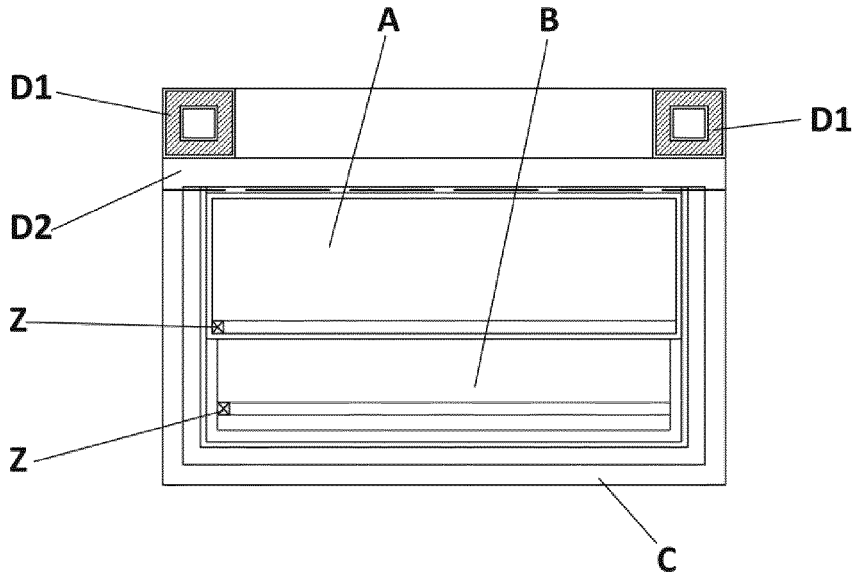
FIG. 4 shows an upper sectioned view of the counter in which the interior of the thermally insulated columns is seen.
Figure 5:
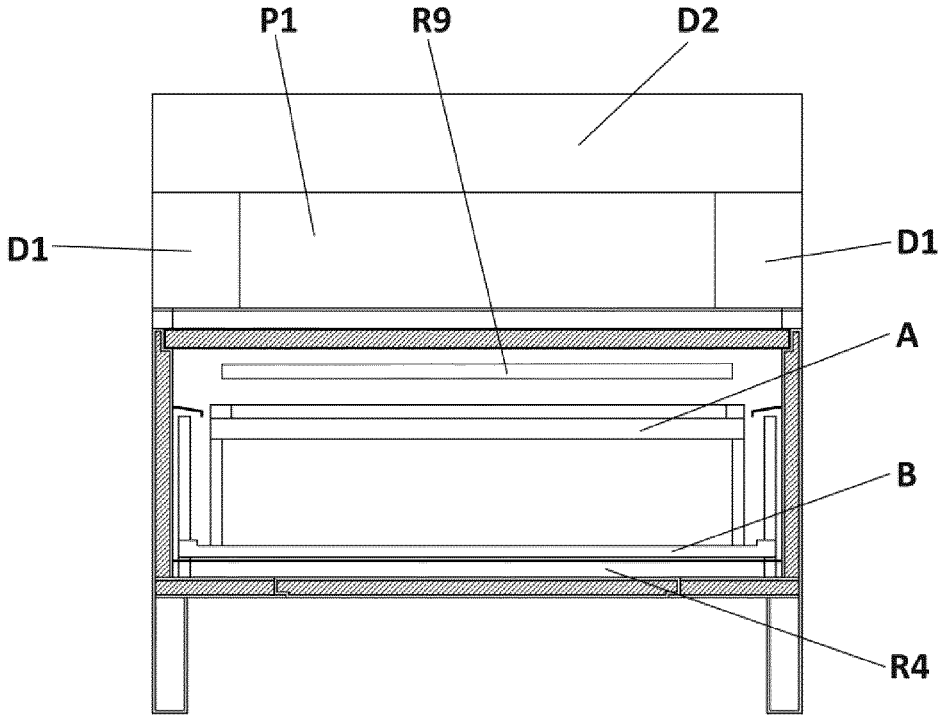
FIG. 5 shows a frontal sectioned view of the counter in which the housing of the self-supporting structure is seen.
Figure 6A:
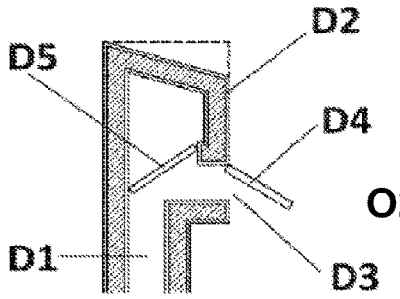
FIGS. 6A-H show a plurality of embodiments of the thermally insulated horizontal conduit, the longitudinal groove and the exterior plate. The option is also shown whereby the exterior air conditioning and freezing system comprises fans in its interior.
Figure 6B:
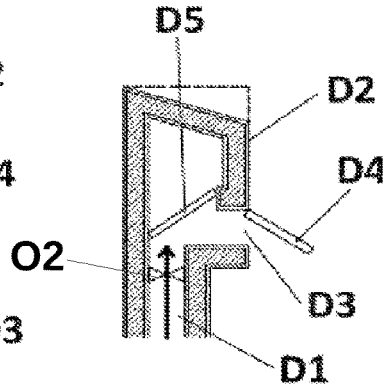
Figure 6C:
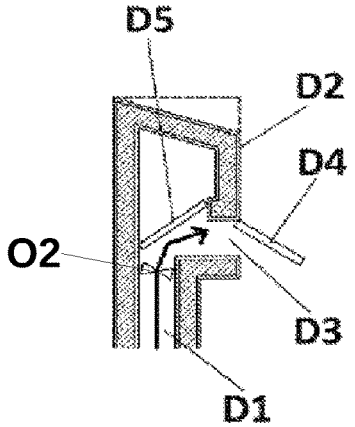
Figure 6D:
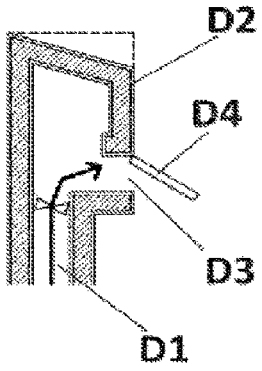
Figure 6E:
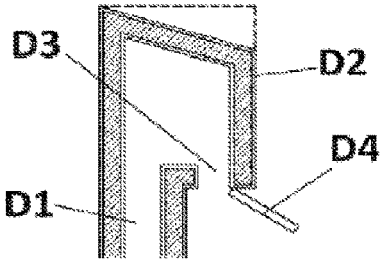
Figure 6F:
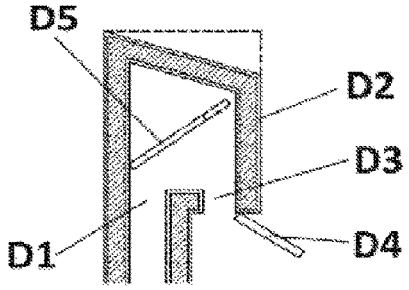
Figure 6G:
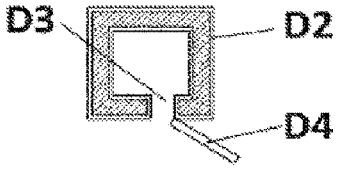
Figure 6H:
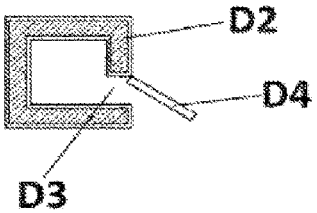

FIG. 4 shows an upper sectioned view of the counter in which an embodiment is observed which comprises two thermally insulated columns (D1). Additionally, in FIG. 5, a sectioned frontal view has been represented in which the interior of the self-supporting structure (C) is seen and where the housing with the tray supports can be seen which, in this case, are two tray supports (A, B). The insulated horizontal air passage (R4) and a third grill (R9) can also be seen. The third grill (R9) can be arranged at any height within the counter and, in the embodiments, in which it is present, it is located between the insulated rear vertical return (R7) and the housing and is capable of moving between a closed position in which it prevents the passage of the air from said insulated rear vertical return (R7) to the housing and an open position in which it allows said passage.

The counter preferably comprises a plurality of internal deflectors configured to distribute the air through the interior of the insulated exterior air conditioning and freezing system (D) and the interior of the conduits of the insulated interior air conditioning and freezing conduits (R).

There is also the possibility (not illustrated in the plans) of the air flow conduits passing through the third grill (R9) and the exterior system D (D1, D2, D3 and D4) being independent. Although the air conditioning and freezing system is common both to the air conditioning and freezing of the interior and to the exterior of the counter, it is possible that the conduits transporting the air towards the exterior system (D) and towards the third grill (R9) are independent.

FIGS. 6A-H show a plurality of possible configuration options of the thermally insulated horizontal conduit (D2), the groove (D3) and the exterior plate (D4). Additionally, it can be seen how, in some exemplary embodiments, the insulated exterior air conditioning and freezing system (D) also comprises one or more secondary plates (D5) arranged at least partially in the insulated horizontal conduit (D2) and in the insulated columns (D1) to control the direction of the air displaced towards said insulated horizontal conduit (D2) from the thermally insulated columns (D1). It also allows the direction in which the air is directed towards the groove (D3) to be controlled.

In an exemplary embodiment, the secondary plates (D5) may be extendable, be movable or be fixed.

An exemplary embodiment can also be seen in which the counter has additional heating systems. In this case, the additional heating systems comprise variable electrical resistors or similar elements along the thermally insulated horizontal conduit (D2) to produce hot air. The resistors are preferably regulated from the exterior. In addition in these cases, there are fans (02) in the thermally insulated horizontal conduit (D2), distributed along the conduit (D2) which force the air towards the exterior through the groove (D3) towards the frontal return opening (R1).

The counter preferably also comprises at least one valve (R8) arranged at the end of the thermally insulated columns (D1) which connects to the insulated interior air conditioning and freezing system (R). The valve (R8) can move between a closed position in which it prevents the passage of conditioned or frozen air from the insulated interior air conditioning and freezing system (R) towards the insulated exterior air conditioning and freezing system (D) and an open position in which it allows said passage.

As has been previously described, the counter can be in a closed position, in which case the valve (R8) is closed and the third grill (R9) is open; it can be in first open position, in which case both the valve (R8) and the third grill (R9) are open; or in a second open position, in which case the valve (R8) is open and the third grill (R9) is closed.

Figure 7A:
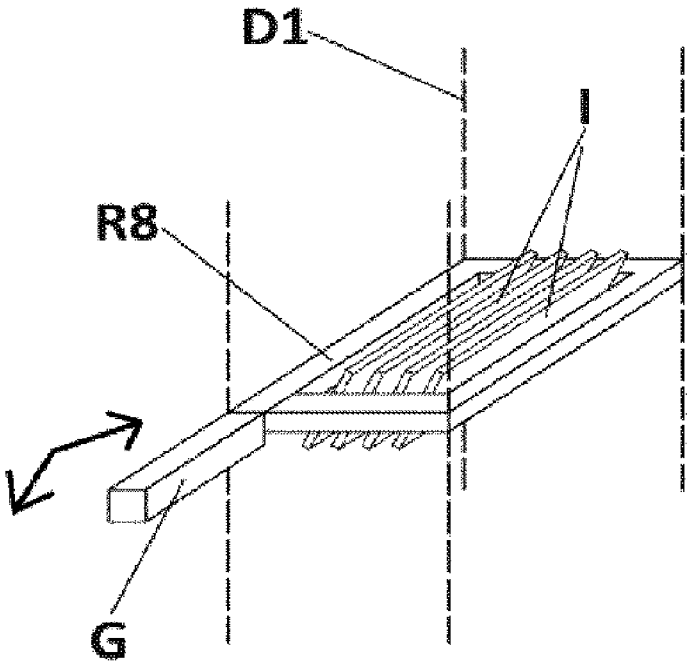
FIG. 7 shows views of an exemplary embodiment of the valve in which it comprises an adjustor so that, from the exterior of the counter, it can be opened or closed to allow or not to allow the passage of the air from the self-supporting structure to the insulated exterior air conditioning and freezing system.
Figure 7B:
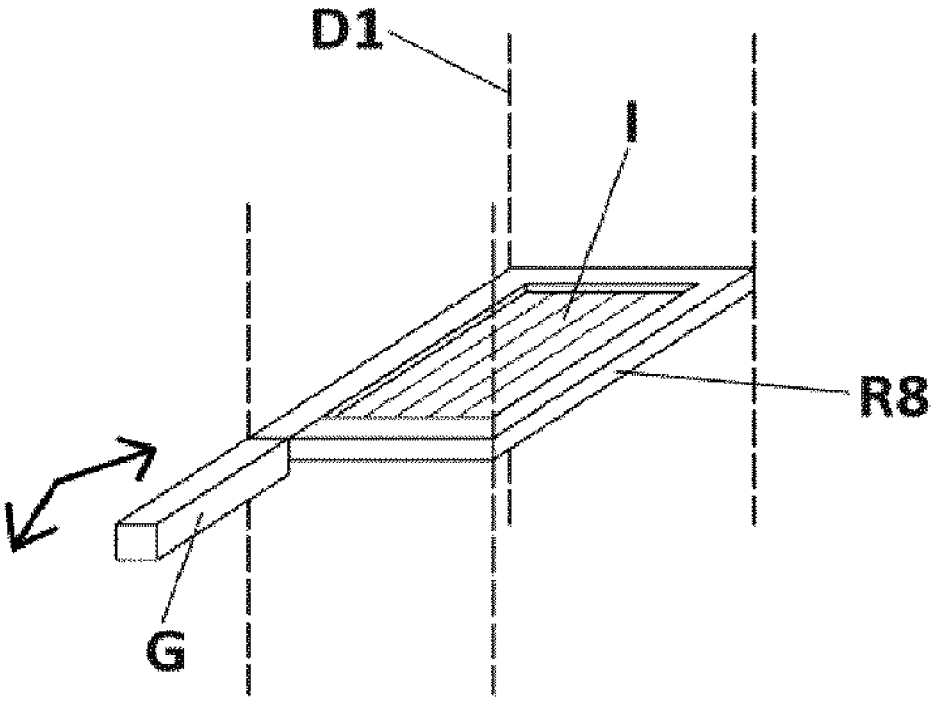
Figure 8C:
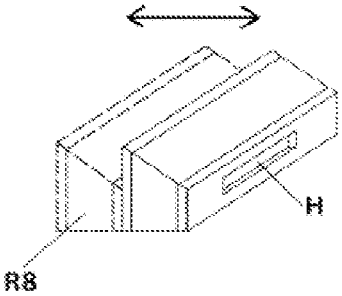
FIGS. 8A-D show sections of the counter in a display and storage position respectively, in another exemplary embodiment of the valve, alternative to the one in FIG. 7.
Figure 8D:
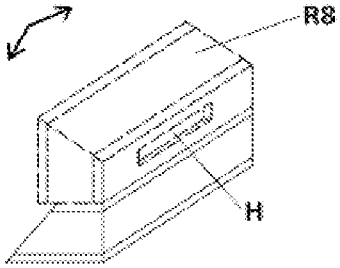
Figure 8A:
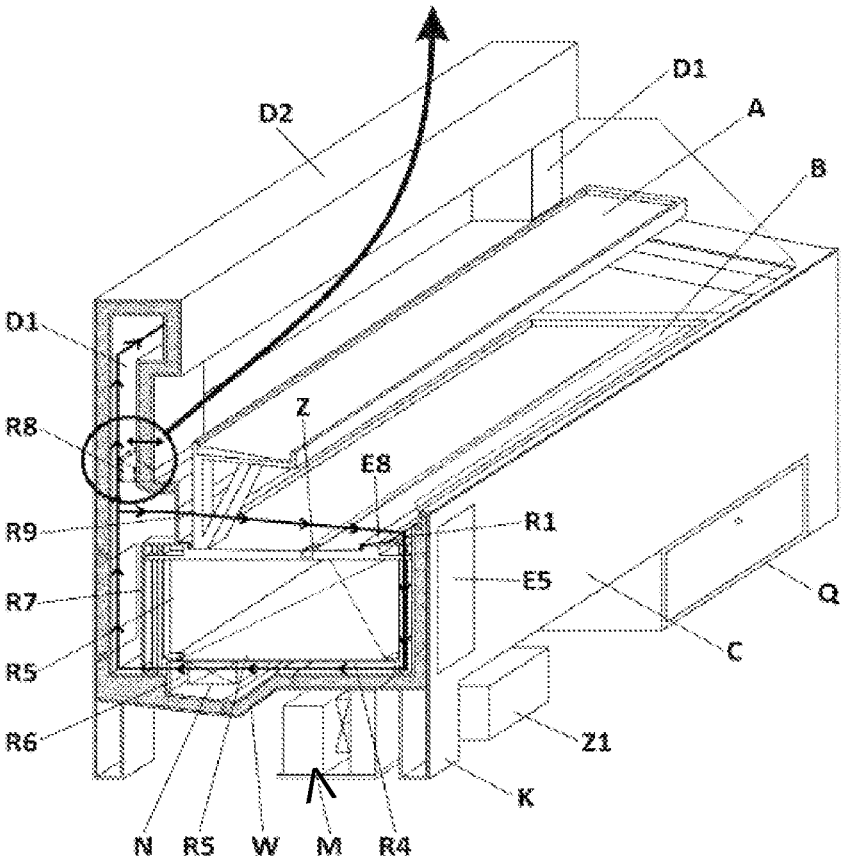
Figure 8B:
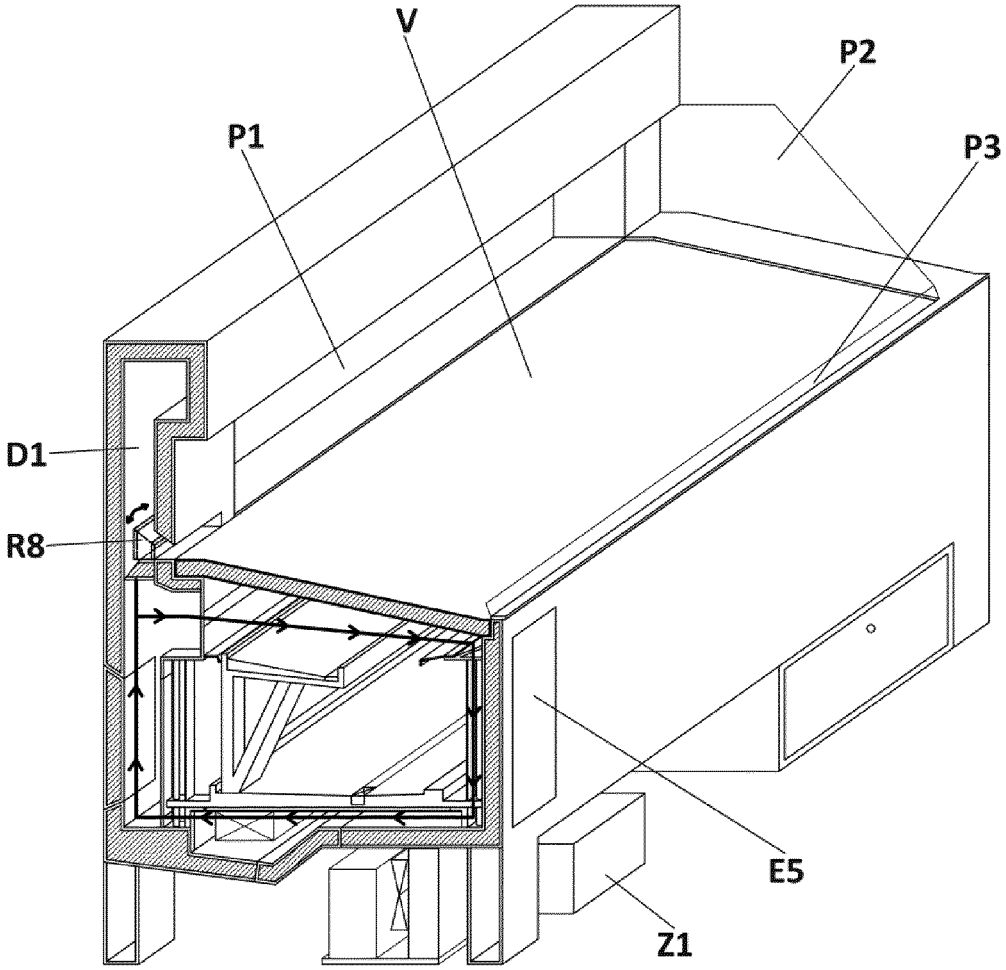

FIG. 7 shows an exemplary embodiment of said valve (R8). In this case, the valve (R8) comprises a manual or automatic adjustor which is actuated from the exterior of the counter. The valve (R8) is made to pass from an open position to a closed position and vice versa by means of the adjustor.

In this case, it is a plurality of sheets (I) which can turn around their longitudinal axis to pass from a position in which they are aligned, preventing the passage of the air towards the columns (D1) and positions in which they are parallel to one another, allowing the passage of air between them.

FIGS. 8A-D show another exemplary embodiment of the valve (R8). In this case, it is a solution comprising a body tilting around an axis joined to an interior wall of the column (D1) or the rear vertical return (R7) in the area in which it is joined to the columns (D1). It can have a handle (H) to facilitate its actuation (that is to say, its tilting).

Figure 9A:
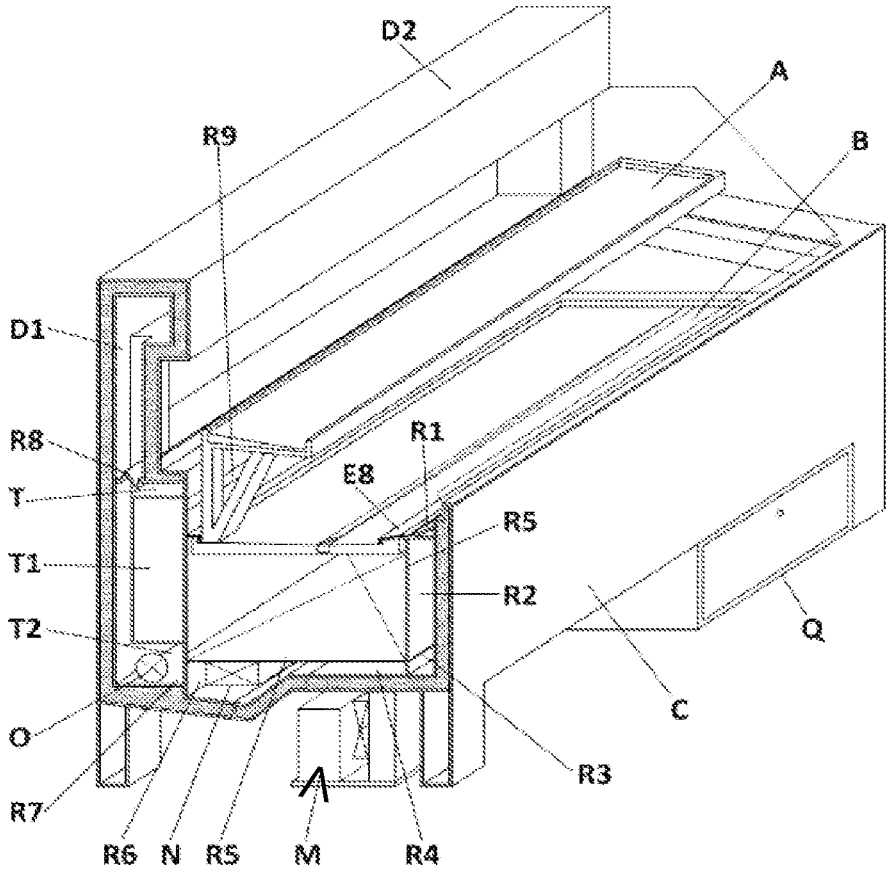
FIGS. 9A-B show sections of the counter in a display and storage position respectively in an exemplary embodiment in the counter comprising at least one deflector in the interior of the self-supporting structure to control the direction of the air from the interior of the self-supporting structure towards the exterior air conditioning and freezing system.
Figure 9B:
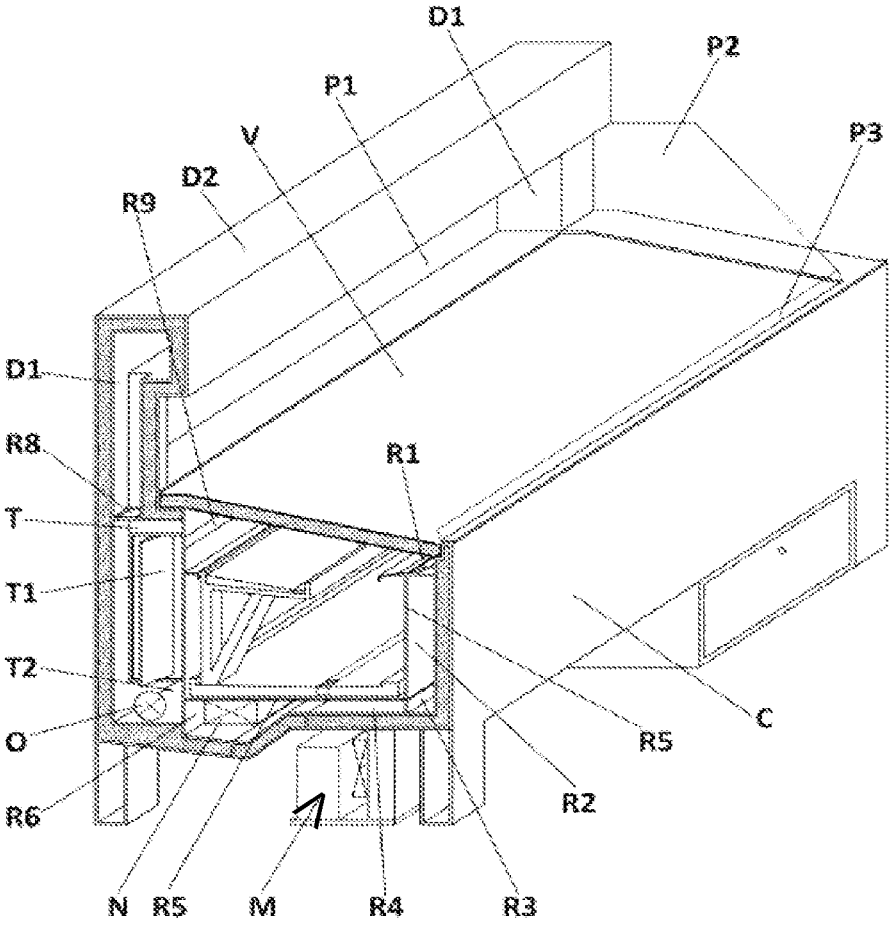

FIGS. 9A-B show an exemplary embodiment in which the counter comprises a deflector (T) arranged in the insulated rear vertical return (R7). Said deflector (T) is, in this case, a flap rotating around a central vertical axis (T1). As a function of the position of the deflector (T), the passage of the air through the rear vertical return (R7) and its direction are controlled. In this case, the deflector (T) is smaller than the insulated rear vertical return (R7) such that it is created a bottom fixed air passage (T2).

Figure 10A:
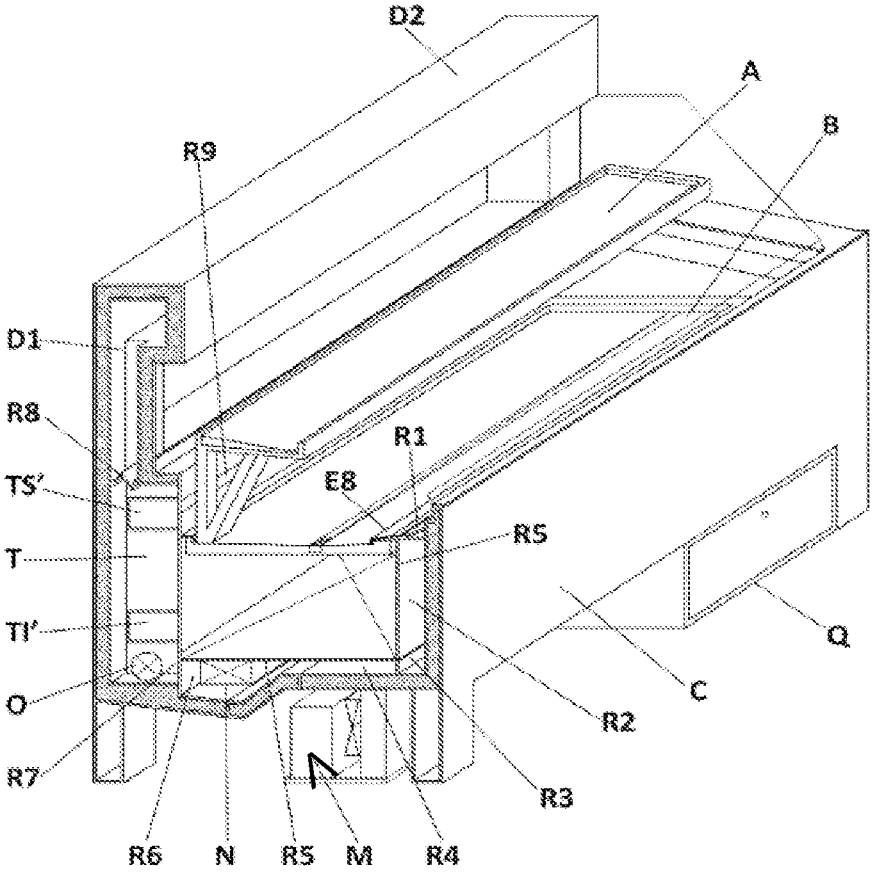
FIGS. 10A-B show sections of the counter in a display and storage position respectively in a second exemplary embodiment of the alternative deflector to the one shown in FIGS. 9A-B.
Figure 10B:
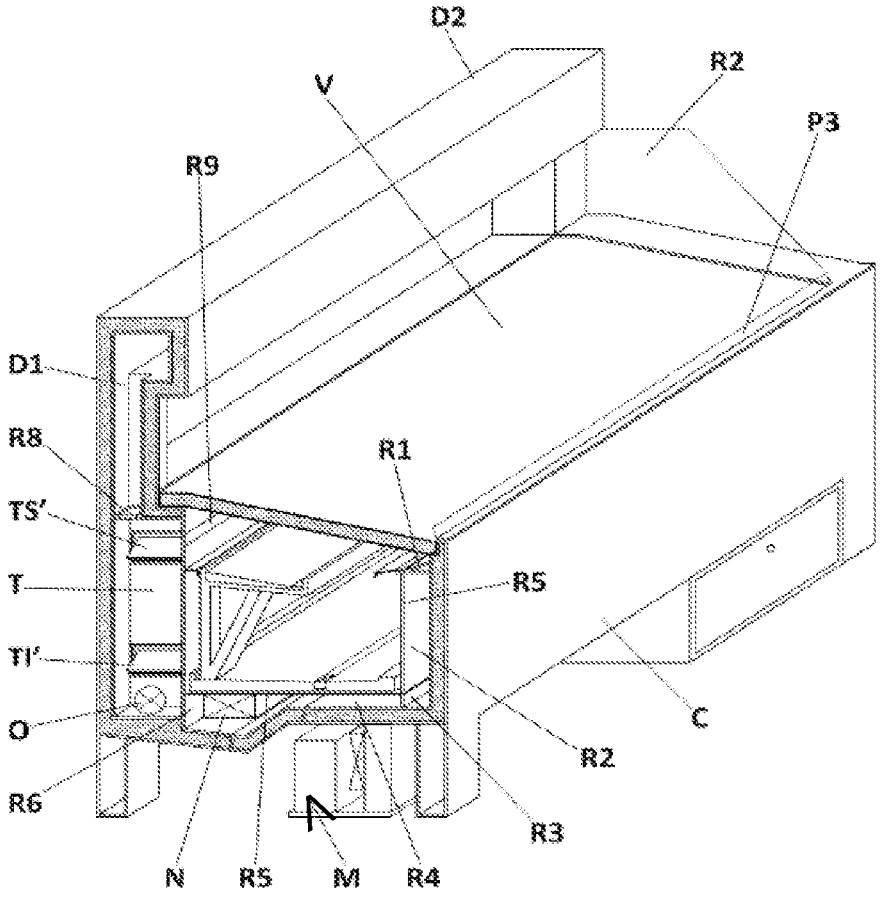

FIGS. 10A-B show another exemplary embodiment in which the deflector (T) comprises a central fixed plate and two flaps (TS', TI') rotating around a horizontal central axis. One of said flaps (TS', TI') is situated on the central fixed plate and the other is situated below. The flaps can be in a position in which they prevent the passage of air through them or in a position in which they allow this and direct the air in the desired direction. Additionally, one of them can be closed and the other open.

Figure 11A:
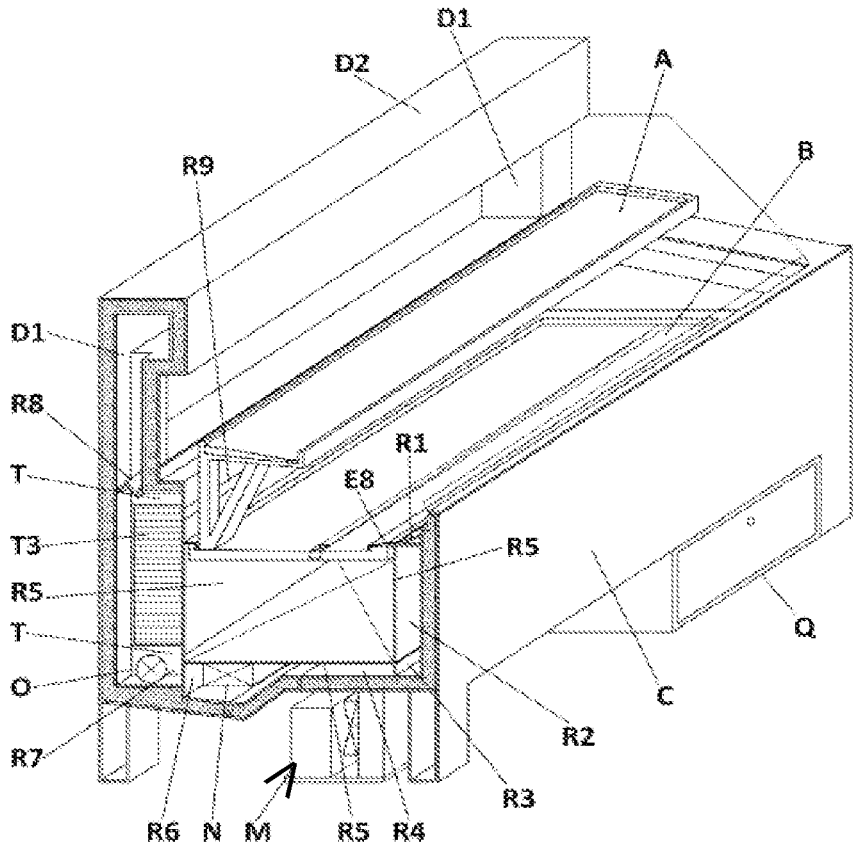
FIGS. 11A-B show sections of the counter in a display and storage position respectively in a third exemplary embodiment of the deflector.
Figure 11B:
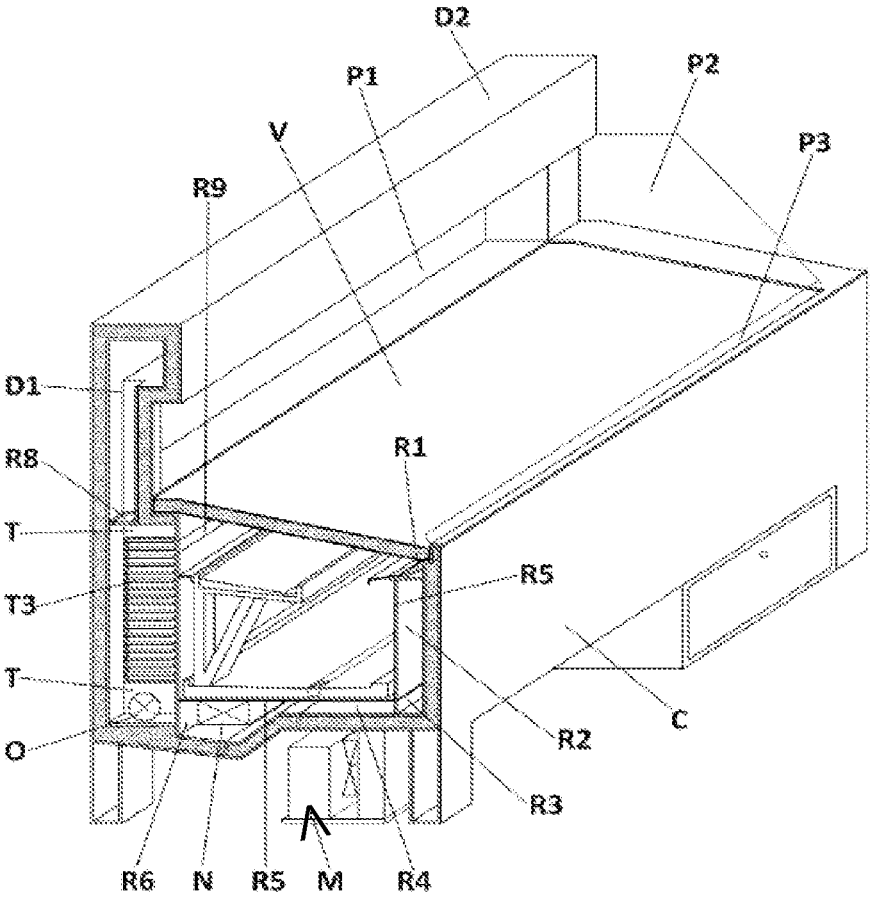

Another exemplary embodiment of the deflector is shown in FIGS. 11A-B. In this case, the deflector (T) comprises a plurality of sheets (T3) which can rotate around a horizontal central longitudinal axis. When the deflector (T) is in the closed position, the sheets are aligned with one another and the passage of air is prevented. When the deflector (T) is in the open position, the sheets are parallel to one another, allowing the passage of the air through the spaces which are free between them. The direction of the air is controlled by means of the greater or lesser degree of inclination of the position of the sheets (T3).

Figure 12A:
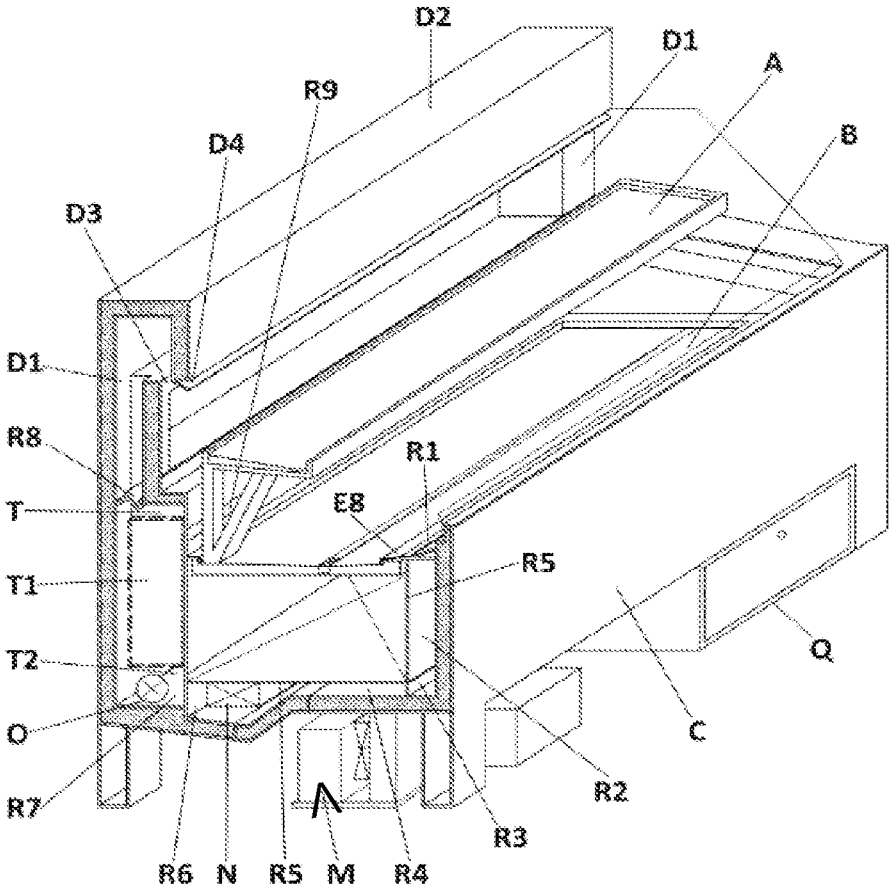
FIGS. 12A-B show sections of the counter in a display and storage position respectively in a fourth exemplary embodiment of the deflector.
Figure 12B:
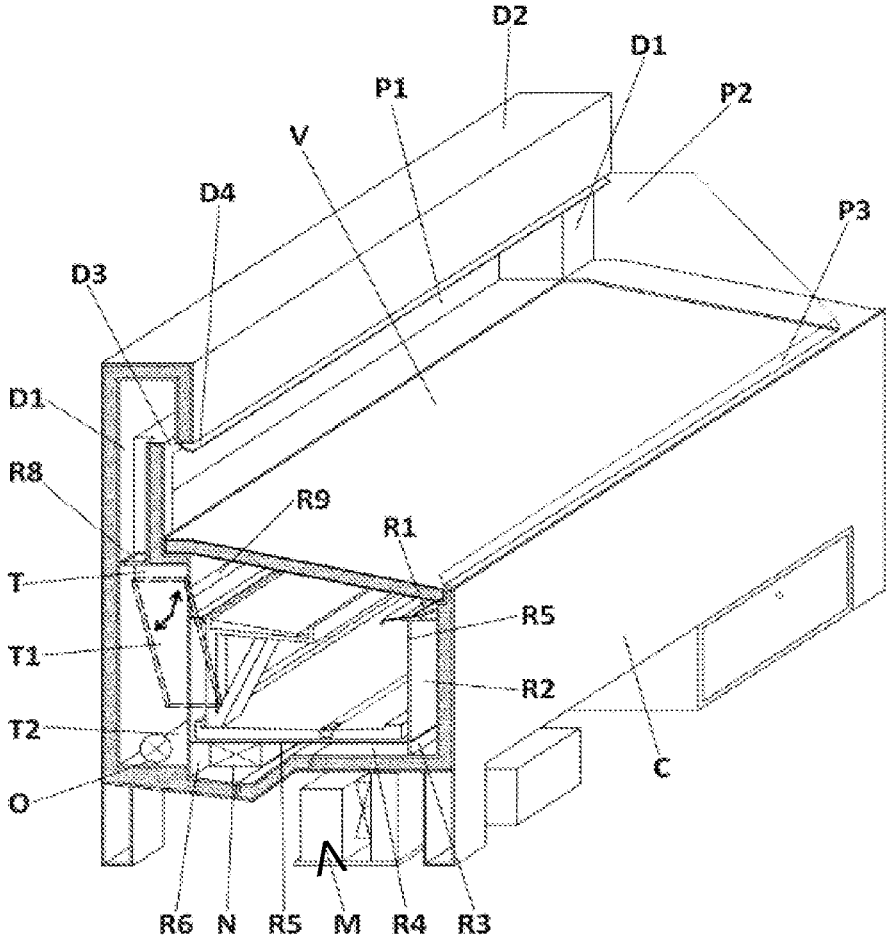
Figure 13A:
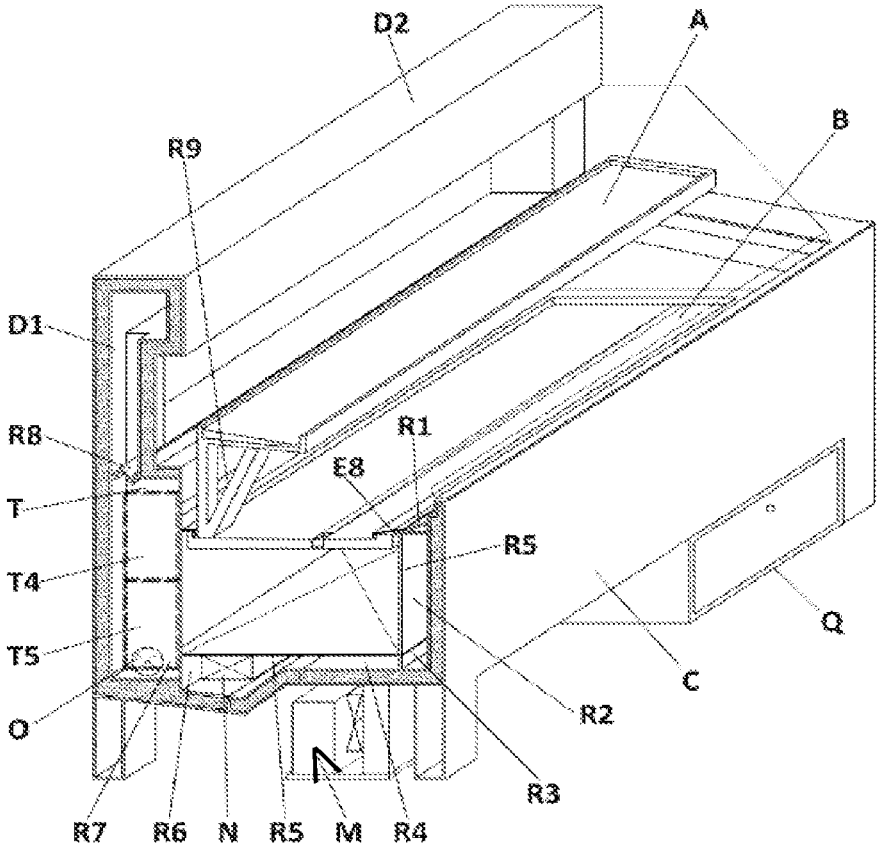
FIGS. 13A-B show sections of the counter in a display and storage position respectively in a fifth exemplary embodiment of the deflector.
Figure 13B:
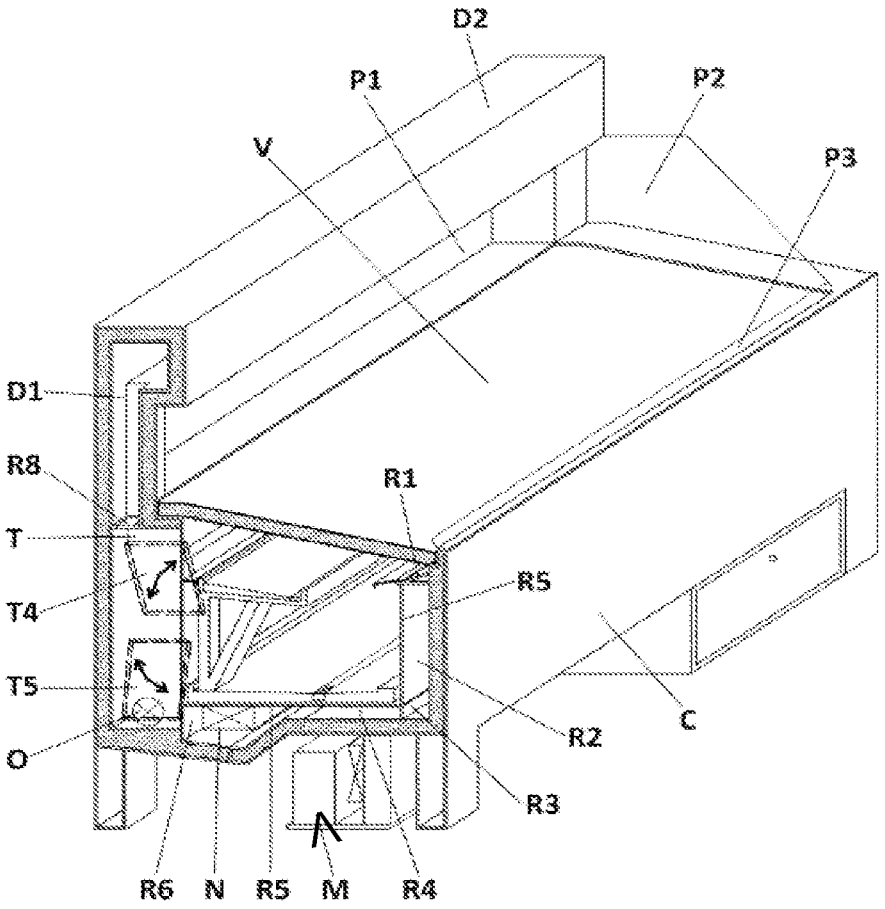

FIGS. 12A-B show an exemplary embodiment in which the deflector (T) is a flap which can tilt around a horizontal axis (T 1) arranged in the joining area with the air conditioning and freezing system (D) where the valve (R8) is located. In this case, the deflector (T) is smaller than the insulated rear vertical return (R7) such that it is created a bottom fixed air passage (T2). FIGS. 13A-B show another embodiment in which the deflector (T) comprises two flaps which each tilt around a horizontal axis, opposing one another such that each of them tilts in the opposite direction to the other. The first tilting flap (T4) tilts around an axis arranged in the joining area to the air conditioning and freezing system (D) where the valve (R8) is located. The second flap (T5) tilts around an axis arranged in the lower area of the air redirection conduits (R2).

Figure 14A:
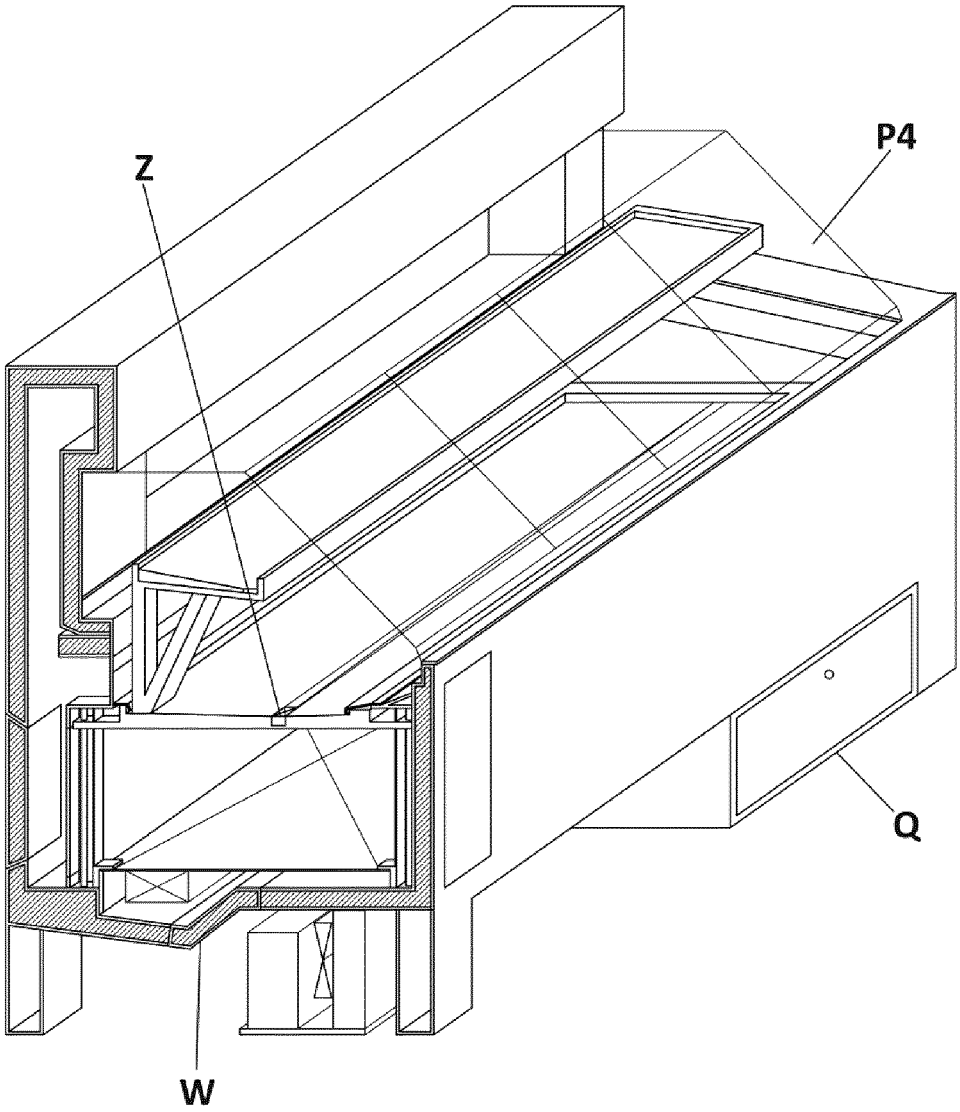
FIG. 14A shows a sectioned perspective view of the counter in which frontal protections are observed which, in this case, are sliding doors.

In a preferred exemplary embodiment, the counter comprises at least lateral protectors (P2) and/or a rear protector (P1) which delimits the space in which the temperature is controlled. Additionally, it can also comprises a minimal frontal protector (P3), arranged in correspondence with the frontal return opening (R1) configured to ensure that the air exiting the longitudinal groove (R3) enters through said frontal return opening (R1) and/or a total frontal protector (P4) as is shown in FIG. 14A (especially indicated when the products being displayed are frozen products). These protectors can be made of glass, methacrylate or similar materials. The lateral protections (P2) ensure the collection of the majority of the air coming from the insulated horizontal conduit (D2) and direct it towards the frontal return opening (R1).

Figure 14B:
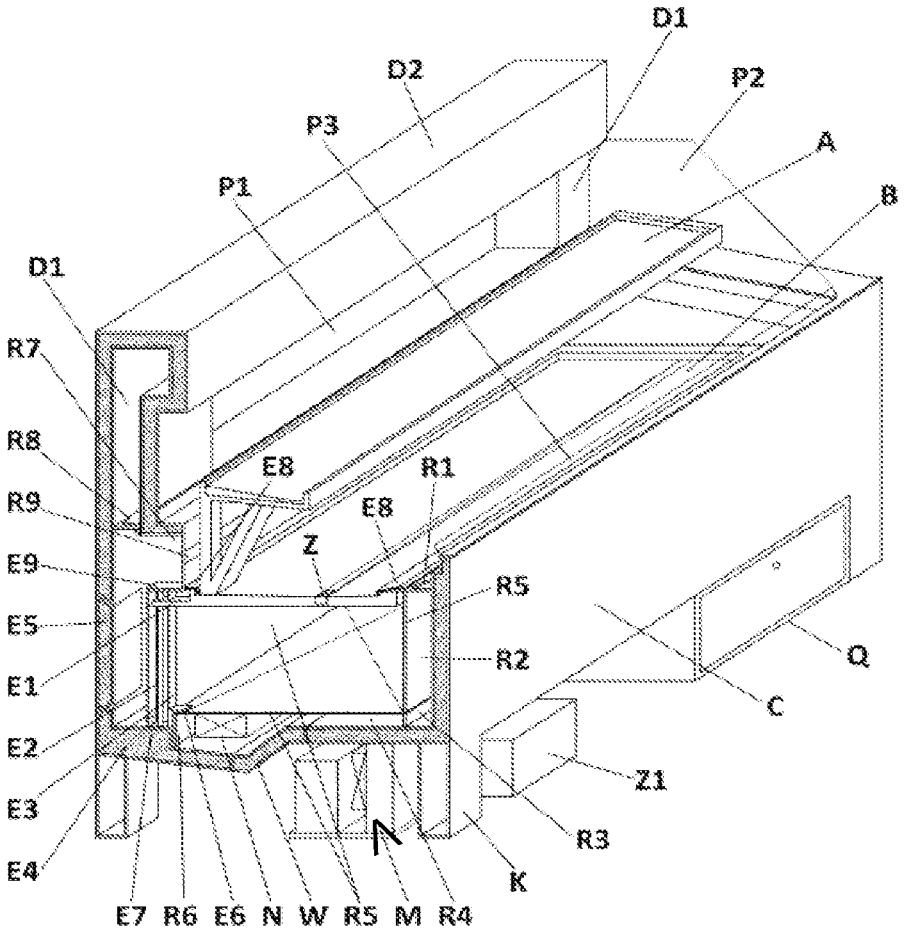
FIG. 14B shows a sectioned view of the counter in which the lifting system of the tray supports is seen.

FIG. 14B shows a sectioned view of the counter in which the lifting system of the tray supports (A, B) can be seen. This lifting system is configured to allow the displacement in the vertical direction of the tray supports (A, B) from the interior of the housing to a position in which the first tray (A) is outside of the housing and the second tray (B) is aligned with the opening of the housing.

In this case, the lifting system comprises at least one joining means (E1) between a guide (E2) and the second tray support (B) which can move in the ascending/descending vertical direction. And these elements are connected to a motor (S). It preferably also comprises a perimeter sheet (E8) to prevent the falling of food into the interior of the counter.

Additionally, the lifting system can comprise security protections (E3) to prevent the risk of entrapment. They can be a type of fixed or movable guard with an interlock (or with an interlock and block). The lifting system is supported on a lower base of the self-supporting structure (E4) which is thermally insulated. The lifting system is also accessible from the exterior by means of a cover of the thermally insulated lifting system (E5).

The lower base of the lifting system is defined by a lower plate (E6) in the manner of a lower stop which can contain a stop elastomer and which geometrically determines a volume in a base of the lifting system (E7) which is used to deposit grease and particles and which is accessible from the exterior. The lifting system is preferably housed in a compartment (E9) in the interior of the self-supporting structure (C) protected by the security protections (E3) to prevent the risk of entrapment and prevent splashes of grease and other splashes.

The lifting system comprises at least two positions for the tray supports (A, B) which are controlled by means of limit switch sensors or similar. Said positions correspond to a display position and a storage position.

In another exemplary embodiment, the counter comprises wheels (100) in the self-supporting structure (C) arranged in the lower section thereof configured to facilitate its displacement. This allows the use of the counter for example in catering and similar. In this case, the condensing unit and the air conditioning and freezing element (M) are anchored via a platform soldered to a leg (K) of the counter.

The water (dirty water with possible residues) is collected in a collector (Z) in the tray supports themselves (A, B) which are inclined towards said collector (Z) to prevent the water of the products displacing towards the bottom of the counter. It is collected there and is channeled to a reservoir situated on the exterior of the counter (Z1).

The motor which controls the air conditioning and freezing element (M) can be situated both in the interior of the counter and on the exterior.

All the systems installed in the counter: air conditioning and freezing system (interior and exterior), raising and lowering movement system of the supports of the trays are controlled from the exterior, manually and/or automatically.

To this end, conventional instruments are required for their control and actuation in an automatic and/or manual manner: there will be temperature and moisture detectors, etc.

The counter can also comprise an auxiliary storage drawer (Q) which can also be air conditioned and/or frozen. Additionally, the counter can comprise a removable lower thermally insulated cover (W) for the maintenance of the evaporator (N).

Figure 15:
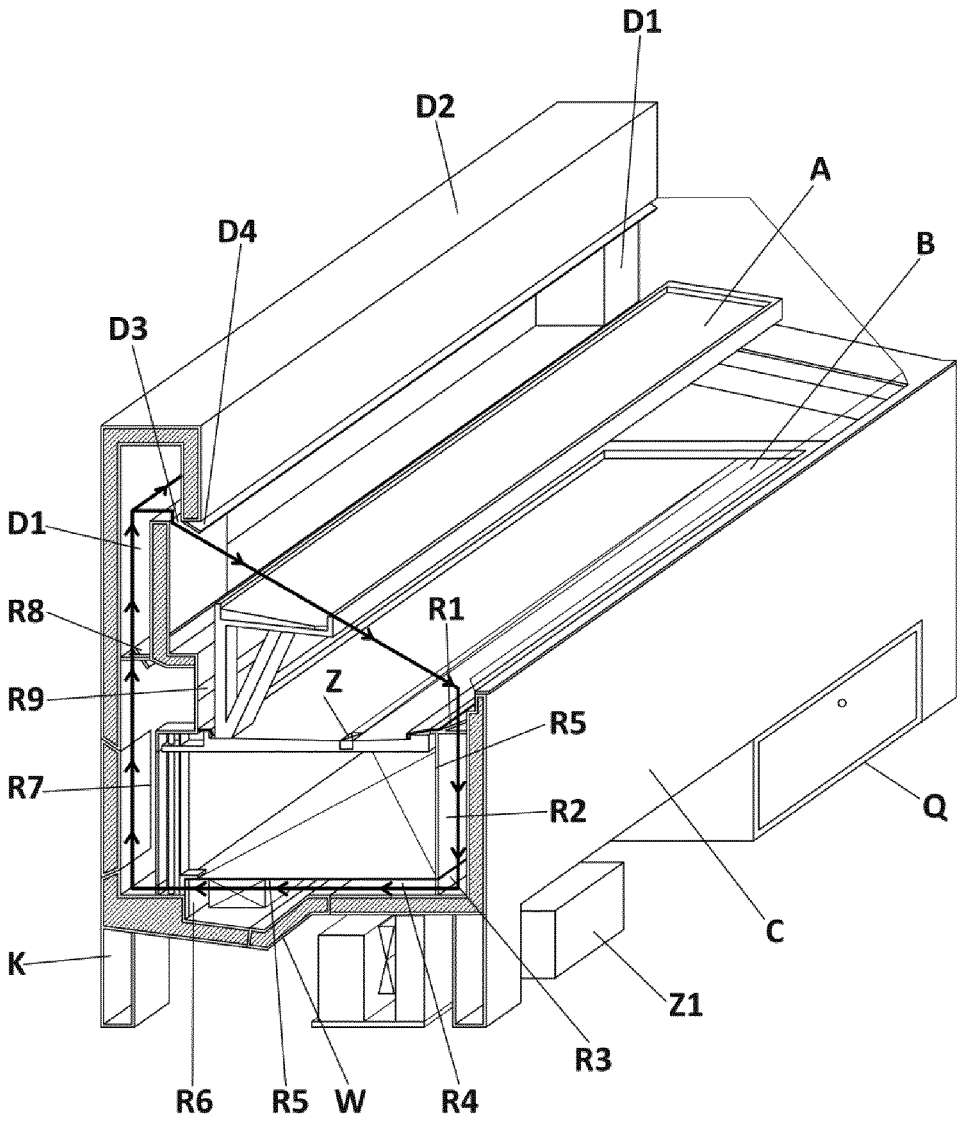
FIG. 15 shows a sectioned view of the counter in which the passage of air is observed only by way of the exterior air conditioning and freezing system, that is to say, with the counter in the second open position.

In FIG. 15, a sectioned view of the counter is observed in which the air passage is observed only through the exterior air conditioning and freezing system, that is to say, with the counter in the second open position.

Figure 16:
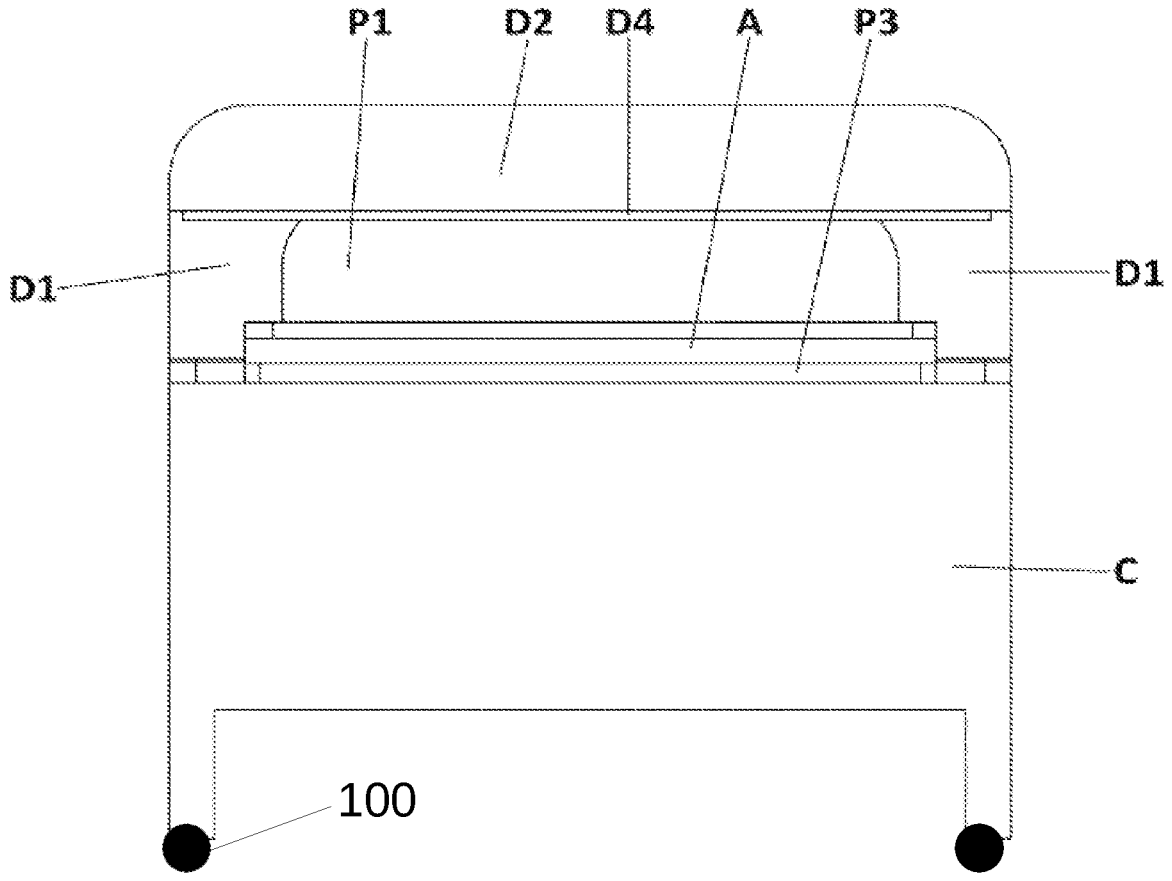
FIG. 16 shows a view of the counter in which rounded edges are observed and an exterior plate is seen which directs the flow of air from the exterior air conditioning/freezing system towards the frontal vertical return of the interior of the counter.

Additionally, FIG. 16 shows an exemplary embodiment of the counter with rounded edges. An exterior plate can also be seen in the figure which directs the flow of air from the exterior air conditioning/freezing system towards the frontal vertical return of the interior of the counter.

What is claimed is:

1. A counter with air conditioning and freezing system comprising a self-supporting structure (C) with:

an insulated housing in which at least one support for trays (A, B) is located;

an air conditioning and freezing element which allows the temperature of an air current circulating through the self-supporting structure (C) to be modified; and the counter comprises:

an insulated interior air conditioning and freezing system (R) arranged on the self-supporting structure (C) configured to direct an air current through the interior of the self-supporting structure (C) and comprising:

a frontal return opening (R1) arranged in an upper frontal section of the support structure (C);

an insulated frontal vertical return (R2) through which the air current, entering through the frontal return opening (R1), passes;

a horizontal air passage (R4) connected to the insulated frontal vertical return (R2) and which is arranged below the housing;

an insulated rear vertical return (R7) through which the air, arriving from the horizontal air passage (R4), passes;

an insulated exterior air conditioning and freezing system (D) which extends from a rear section of the self-supporting structure (C) and which is configured to create an air curtain and comprises:

at least one thermally insulated column (D1) which extends from the self-supporting structure (C) and which is hollow and is connected to the insulated rear vertical return (R7) to allow the passage of the air from the insulated rear vertical return (R7);

a thermally insulated horizontal conduit (D2) connected to the at least one thermally insulated column (D1) for the passage of the air from the at least one thermally insulated column (D1);

a longitudinal groove (D3) which extends through the thermally insulated horizontal conduit (D2) through which the longitudinal groove exits;

an exterior plate (D4) arranged in correspondence with the longitudinal groove (D3) oriented at an inclination such that exterior plate controls the exit direction of the air which passes through the longitudinal groove (D3) and directs the air towards the frontal return opening (R1), creating the air curtain.

2. The counter with air conditioning and freezing system according to claim 1, wherein the insulted rear vertical return (R7) is connected to the housing.

3. The counter with air conditioning and freezing system according to claim 2, further comprising a grill (R9) arranged between the insulated rear vertical return (R7) and the housing and the grill (R9) is movable between a closed position and an open position, the closed position preventing the passage of the air from the insulated rear vertical return (R7) to the housing and the open position allowing the passage of the air from the insulated rear vertical return (R7) to the housing.

4. The counter with air conditioning and freezing system according to claim 1, further comprising a grill (R6) between the horizontal air passage (R4) and the insulated rear vertical return (R7).

5. The counter with air conditioning and freezing system according to claim 1, further comprising a first grill (R3) of horizontal air passage (R4) connected to the insulated frontal vertical return (R2).

6. The counter with air conditioning and freezing system according to claim 1, further comprising at least one valve (R8) arranged at the end of the at least one thermally insulated column (D1) which connects to the insulated interior air conditioning and freezing system (R), wherein the at least one valve (R8) is movable between a closed position and an open position, the closed position preventing the passage of the conditioned or frozen air from the insulated interior air conditioning and freezing system (R) towards the insulated exterior air conditioning and freezing system (D) and the open position allowing the passage of the conditioned or frozen air from the insulated interior air conditioning and freezing system (R) towards the insulated exterior air conditioning and freezing system (D).

7. The counter with air conditioning and freezing system according to claim 6, wherein the at least one valve (R8) comprises an adjustor (G) and a plurality of sheets (I) for rotating around their longitudinal axis to pass from a position in which they are aligned, preventing the passage of the air towards the at least one thermally insulated column (D1) and positions in which they are parallel to one another, allowing the passage of air between them and the position of the sheets (I) is modified with the adjustor (G).

8. The counter with air conditioning and freezing system according to claim 6, wherein the at least one valve (R8) comprises a body tilting around an axis joined to an interior wall of the at least one thermally insulated column (D1) or the insulated rear vertical return (R7) in the area in which the insulated rear vertical return is joined to the at least one thermally insulated column (D1).

9. The counter with air conditioning and freezing system according to claim 6, wherein the at least one valve (R8) is insulated and comprises a handle (H).

10. The counter with air conditioning and freezing system according to claim 1, further comprising a plurality of internal deflectors configured to distribute the air through the interior of the insulated exterior air conditioning and freezing system (D) and the interior of conduits of the insulated interior air conditioning and freezing system (R).

11. The counter with air conditioning and freezing system according to claim 1, further comprising movable secondary plates (D5) arranged in the interior of the thermally insulated horizontal conduit (D2) configured to control the direction of the air passing through the interior of thermally insulated horizontal conduit (D2).

12. The counter with air conditioning and freezing system according to claim 1, further comprising movable secondary plates (D5) arranged in the interior of the thermally insulated column (D1) configured to control the direction of the air passing through the interior of the at least one thermally insulated column (D1).

13. The counter with air conditioning and freezing system according to claim 1, further comprising at least one fan in the at least one thermally insulated column (D1).

14. The counter with air conditioning and freezing system according to claim 1, further comprising a thermal insulation cover (V) for the opening and closing of the housing.

15. The counter with air conditioning and freezing system according to claim 14, wherein the thermal insulation cover (V) is a practicable integral screen.

16. The counter with air conditioning and freezing system according to claim 1, further comprising a deflector (T) arranged in the interior of the self-supporting structure (C).

17. The counter with air conditioning and freezing system according to claim 16, wherein the deflector (T) comprises a central fixed plate and two flaps (TS', TI') rotating around a central axis or horizontal lateral axis with one of them situated on the central plate and another situated below.

18. The counter with air conditioning and freezing system according to claim 16, wherein the deflector (T) comprises a plurality of sheets (T3) for rotating around a central longitudinal axis or horizontal lateral axis such that when the deflector (T) is in the closed position, the sheets are aligned with one another and when the deflector (T) is in the open position, the sheets are parallel to one another.

19. The counter with air conditioning and freezing system according to claim 16, wherein the deflector (T) is a flap for tilting around a horizontal axis or vertical axis arranged in the joining area with the air conditioning and freezing system (D).

20. The counter with air conditioning and freezing system according to claim 16, wherein the deflector (T) is smaller than the insulated rear vertical return (R7) such that the insulated rear vertical return is created a bottom fixed air passage (T2).

21. The counter with air conditioning and freezing system according to claim 16, wherein the deflector (T) is smaller than the insulated rear vertical return (R7) such that there is an upper fixed air passage between the horizontal axis around which the deflector (T) tilts and an interior upper area of the self-supporting structure (C).

22. The counter with air conditioning and freezing system according to claim 16, wherein the deflector (T) comprises two flaps which each tilt around a horizontal axis, opposing one another such that each of them tilts in the opposite direction to the other, wherein a first tilting flap (T4) tilts around an axis arranged in the joining area to the air conditioning and freezing system (D) where a valve (R8) is located and a second flap (T5) tilts around an axis arranged in the lower area of the redirection conduits of the air (R2).

23. The counter with air conditioning and freezing system according to claim 1, further comprising at least lateral protectors (P2) or a rear protector (P1) which delimit the space in which the temperature is controlled.

24. The counter with air conditioning and freezing system according to claim 1, further comprising a frontal protector (P3), arranged in correspondence with the frontal return opening (R1) configured to ensure that the air exiting the longitudinal groove (R3) enters through the frontal return opening (R1).

25. The counter with air conditioning and freezing system according to claim 1, further comprising wheels in the self-supporting structure (C) arranged in the lower section thereof.

26. The counter with air conditioning and freezing system according to claim 1, further comprising a plurality of internal fans configured to distribute the air through the interior of the insulated exterior air conditioning and freezing system (D) and the interior of the insulated interior air conditioning and freezing system (R).

* * * * *